United States Patent [19]

Jones

[11] 4,171,171

[45] Oct. 16, 1979

[54] LONG HANDLED LIQUID DISPENSING APPLICATOR

[76] Inventor: Ronald B. Jones, 901 6th St., SW., Washington, D.C. 20024

[21] Appl. No.: 875,861

[22] Filed: Feb. 7, 1978

[51] Int. Cl.[2] ..... B43K 5/18

[52] U.S. Cl. ..... 401/150; 401/196; 401/202; 401/262

[58] Field of Search ..... 401/118, 119, 126, 130, 401/180, 176, 191, 202, 196, 262, 269, 140, 144, 179, 182, 205, 206, 188 R, 187, 150, 138

[56] References Cited

U.S. PATENT DOCUMENTS

| | | | |
|---|---|---|---|
| 2,047,199 | 7/1936 | Gewalt | 401/150 X |
| 2,557,214 | 6/1951 | Bates | 401/140 |
| 2,772,430 | 12/1956 | Moritt | 401/150 X |
| 3,118,166 | 1/1964 | Bell | 401/150 X |
| 3,186,024 | 6/1965 | McLemore | 401/150 |
| 3,286,297 | 11/1966 | MacFarland | 401/179 |
| 3,403,961 | 10/1968 | Gazzani | 401/202 |
| 3,519,364 | 7/1970 | Truhan | 401/196 X |
| 4,078,865 | 3/1978 | Moser | 401/202 X |

*Primary Examiner*—Edward M. Coven
*Attorney, Agent, or Firm*—Herman L. Gordon

[57] ABSTRACT

A long-handled dispenser device for applying lotion or other liquid material to parts of the body. The device consists of a long arcuately curved tubular handle employed as a reservoir for the material, with a screw plug at its free end. The handle is attached to a head member having a large applicating sponge. The head member has a plunger-operated suction pump connected to rigid inlet tubing extending through the handle to its free end region. The pump has a discharge spout directed into the sponge. A snap-on detachable cover tray is provided on the head member, serving as a lotion-collecting receptacle to receive lotion from the pump when the pump is actuated, to form a shallow pool to moisten the bottom portion of the sponge. For applying the lotion, the tray is detached from the head member. Subsequently the sponge may be dipped into the tray for remoistening.

3 Claims, 5 Drawing Figures

LONG HANDLED LIQUID DISPENSING APPLICATOR

FIELD OF THE INVENTION

This invention relates to liquid applicators, and more particularly to a liquid applicating device of the long-handled dispensing type.

BACKGROUND OF THE INVENTION

It is frequently necessary for a person to apply lotion or other material to his back. This is usually very difficult, often requiring assistance by another individual. Also, this problem may arise with respect to other relatively inaccessible portions of the body, particularly for elderly or handicapped persons. Therefore there is a need for an implement to aid in the accomplishment of this task.

For example, a long-handled sponge may be employed by a person for applying lotion or other material to his back, such as for the self-application of sun tan lotion. Although this is a simple and inexpensive implement, it has certain disadvantages in that it requires frequent moistening, is uneconomical in the use of lotion, is subject to drying out and stiffening of the sponge element when not in use, and is subject to undesired contamination. Also, it requires frequent transfer of lotion from its original bottle or other container to the surface of the sponge, and requires a considerable degree of saturation of the sponge. This results in considerable waste of lotion, inconvenience in applying lotion to the user's body, and relatively rapid deterioration of the sponge element.

SUMMARY OF THE INVENTION

Accordingly, a main object of the present invention is to provide a novel and improved long-handled applicator device which overcomes the above-described disadvantages.

A further object of the present invention is to provide an improved applicator for lotion or other material which enables a user to reach otherwise inaccessible areas of his body without pain or discomfort.

A still further object of the invention is to provide an improved lotion dispenser which has an easily removable airtight cover element over its applicating pad to prevent drying out or deterioration of the pad when the device is not in use.

A still further object of the invention is to provide an improved lotion dispenser and applicator which includes a lotion reservoir in its handle and which is provided with easily operable means for transferring lotion from said handle to the applicating pad of the device and for moistening said pad in an efficient and economical manner.

A still further object of the invention is to provide an improved long-handled dispensing applicator for lotion or other liquid material, which is compact in size, involves relatively simple and inexpensive parts, which is easy to refill when required, which is protected against deterioration or contamination, and which avoids waste of the liquid material to be dispensed.

BRIEF DESCRIPTION OF THE DRAWINGS

Further objects and advantages of the invention will become apparent from the following description and claims, and from the accompanying drawings, wherein:

DESCRIPTION OF A PREFERRED EMBODIMENT

Figure 1:
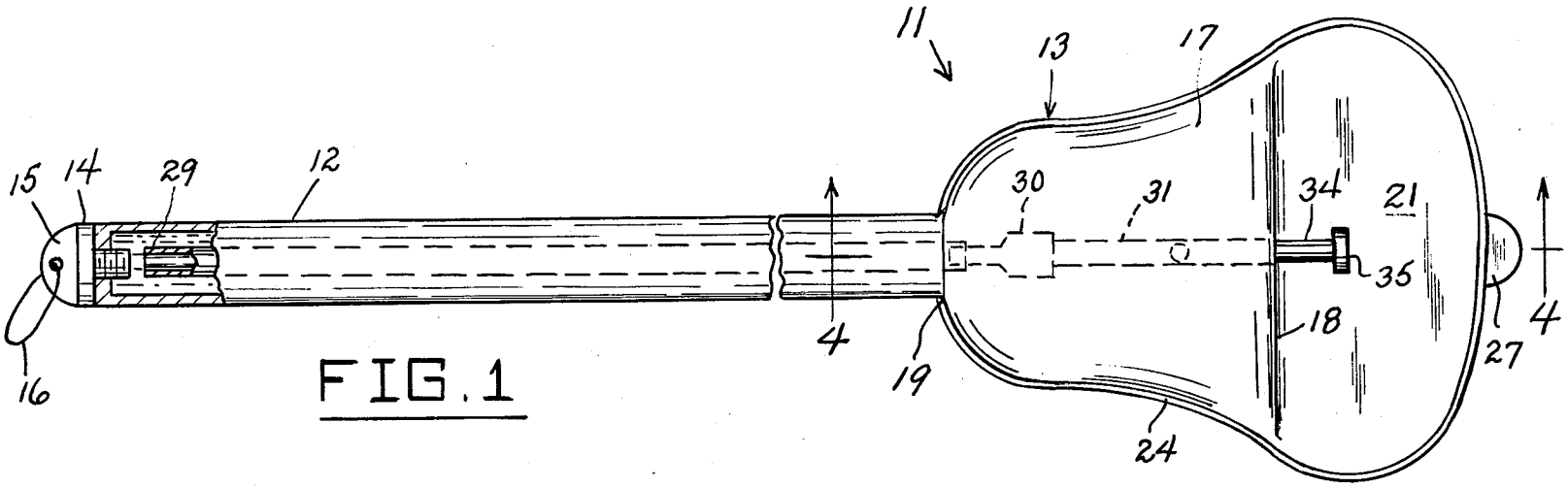
FIG. 1 is a top plan view, partly in cross-section, of a dispensing applicator device according to the present invention.

Referring to the drawings, 11 generally designates a typical dispensing device according to the present invention. The dispensing device 11 comprises an arcuately curved long tubular handle 12, employed as a reservoir for lotion or other liquid material to be applied to the body, the handle 12 being rigidly attached at 19 to a head member 13. The reservoir-handle 12 is provided at its end with a screw closure plug 14. The plug 14 has an apertured diametral flange 15 to which a suitable supporting loop 16 is attached, for hanging up the dispenser when not in use.

Figure 2:
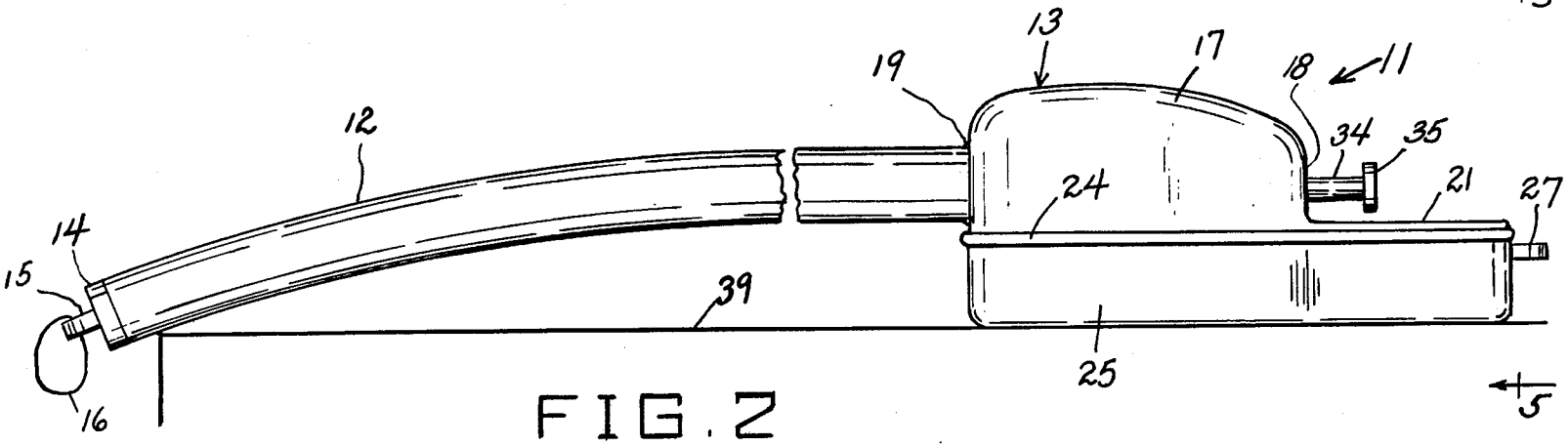
FIG. 2 is a side elevational view of the dispensing applicator device of FIG. 1.
Figure 3:
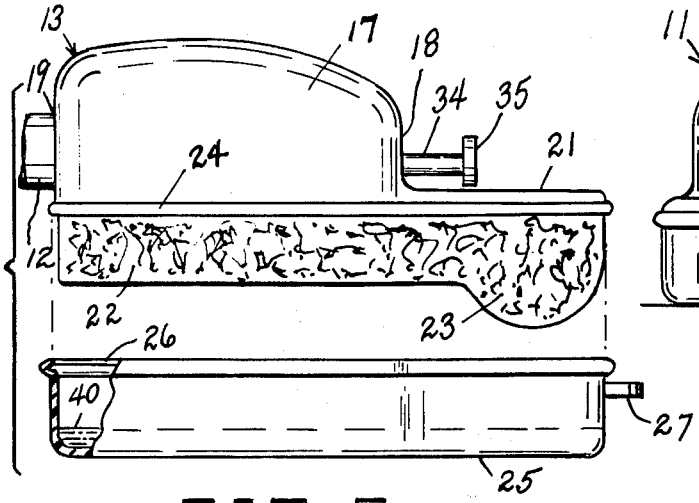
FIG. 3 is a side elevational view of the head member of the applicator device of FIGS. 1 and 2, with the cover tray member, shown partly broken away, in detached position, exposing the applicator sponge element.
Figure 5:
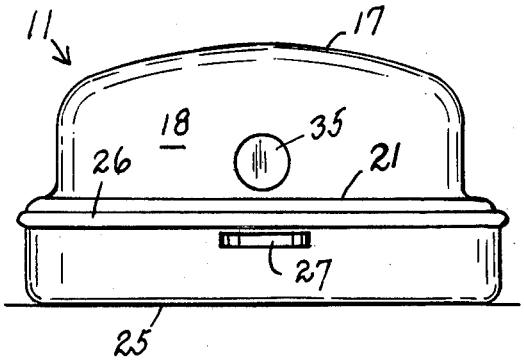
FIG. 5 is an end elevational view taken substantially on the line 5—5 of FIG. 2.
Figure 4:
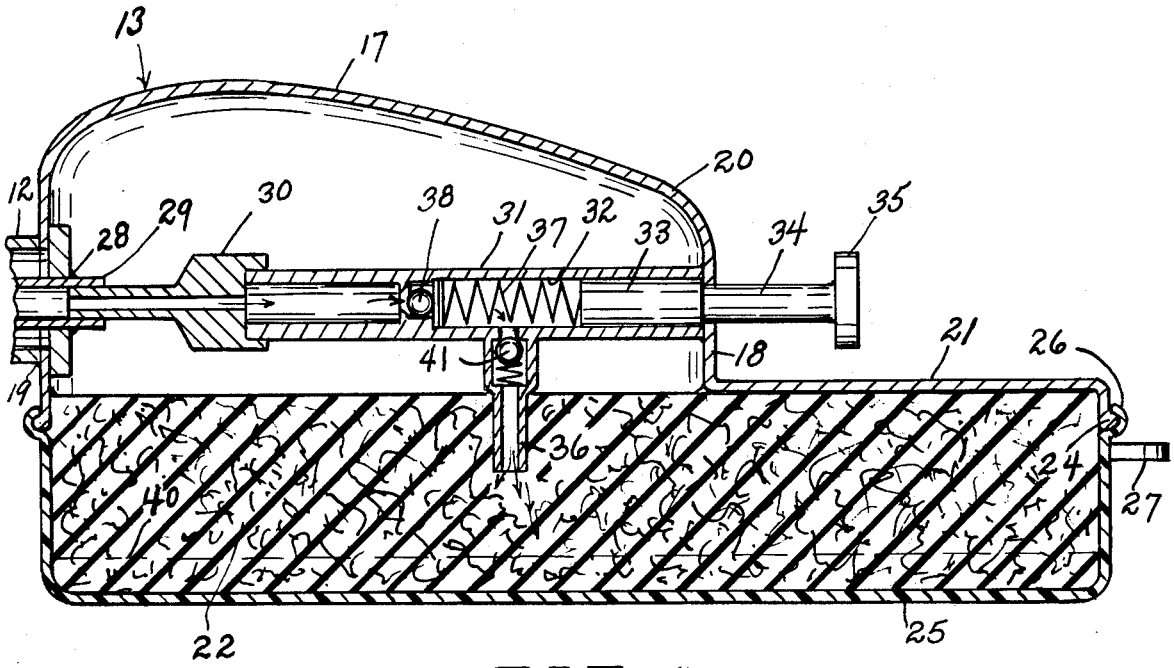
FIG. 4 is an enlarged longitudinal vertical cross-sectional view taken substantially on the line 4—4 of FIG. 1.

Head member 13 comprises a shell 20 formed to define an upstanding pump compartment 17 having a transverse vertical shoulder wall portion 18 opposite the connection 19 of tubular handle 12 to the shell at 19, as viewed in FIGS. 2 and 4. As shown in FIG. 1, the head shell flares forwardly in width and has a flat, relatively wide portion 21 forwardly adjacent shoulder 18. Secured to the inside bottom portion of the shell 20 is a depending body of soft resilient absorbent material 22, such as sponge material, or the like. The absorbent pad 22 may be suitably shaped for engaging in concave body areas, for example, may have an integral normally depending transverse forward portion 23.

The bottom peripheral edge of the shell 20 has an outwardly projecting locking rib 24. A tray-shaped cover member 25 of somewhat resilient yieldable material, such as plastic, is shaped to conformably receive the bottom peripheral edge of the shell 20 and has an inwardly facing top rim channel 26 in which the rib 24 is lockingly engageable in substantially airtight relationship. The tray member 25 is dimensioned to tightly receive the sponge-like resilient pad 22 and to compress said pad when the rim channel 26 is lockingly and sealingly engaged over the shell rib 24. Thus, the cover-tray 25 has a snap-locking sealing cooperation with the shell 20. A finger tab 27 may be provided on the cover-tray 25 to facilitate removal of the cover-tray 25 when desired.

Rigidly secured at 28 and extending substantially concentrically in handle 12 for almost its entire length is a delivery tube 29 which is connected by a coupling member 30 to the inlet portion of a tubular dispensing pump housing 31 rigidly secured at wall 18 in the housing portion 17.

The dispensing pump housing 31 is formed with a bore 32 in which is slidably and sealingly disposed a plunger 33 having an operating stem 34 extending slidably through shoulder wall 18 and provided with an actuating push button 35. Housing 31 is integrally formed with a depending discharge spout 36 extending into the porous sponge pad 22, as shown in FIG. 4. A coiled spring 37 is provided in the bore 32, acting to bias plunger 33 against shoulder wall 18 and away from discharge spout 36. A conventional ball-type check valve 38 is provided between bore 32 and the intake portion of tubular housing 31, adapted to close responsive to inward movement of plunger 33 and to open responsive to the suction generated by plunger 33 when spring 37 pushes it outwardly. An upwardly spring-biased ball check valve 41 is provided between bore 32 and spout 36 which is normally closed but which opens responsive to the inward pressure stroke of plunger 33 and allows liquid to pass from said bore into the spout. Thus, suction is developed in bore 32 when plunger 33 moves to the right, as viewed in FIG. 4, under the force of spring 37, allowing liquid to be drawn into the bore 32 from handle 12, the liquid being expelled through spout 36 into sponge pad 22 when plunger 33 is subsequently manually moved to the left against the biasing force of spring 37. Delivery of the liquid to the sponge therefore occurs responsive to the reciprocation of push button 35.

It is to be noted that although the sponge-like absorbent pad 22 allows some diffusion of liquid from spout 36 to take place therein, this diffusion action is relatively slow and in itself would not provide sufficiently rapid saturation of pad 22, as well as requiring an unnecessarily large amount of liquid for complete saturation. For this reason, the tray member 25 is utilized to collect a sufficient amount of liquid to cover its bottom to a depth required to saturate the bottom surface layer of the sponge-like pad 22. Thus, in one mode of operation, with the tubular handle 12 containing an adequate supply of the lotion or other liquid to be applied to the body, the device 11 may be placed on a suitable horizontal supporting surface 39, as shown in FIG. 2, and the push button 35 may be reciprocated a sufficient number of times to deliver a quantity of the liquid to pad 22 sufficient to form a layer of liquid in the bottom of tray 25 of the depth required to saturate the bottom surface layer of the pad. This layer will be formed by the descent of the liquid from spout 36 through the subjacent portion of the porous pad 22, and this descent occurs relatively rapidly, mainly by the force of gravity. After a relatively small number of reciprocations of push button 35, a sufficient quantity of liquid can be transferred from handle-reservoir 12 to form a shallow pool 40 of liquid in tray-cover 25 and to saturate the bottom surface portion of sponge pad 22. The cover 25 is preferably transparent so that the shallow pool of liquid will be visible.

In another possible procedure, the head portion of the device is held upright with the handle 12 depending therefrom and the push button 35 is reciprocated a sufficient number of times to transfer enough lotion to the sponge to provide the necessary moistening of the sponge, the amount transferred being visible through the transparent cover 25.

After a sufficient amount of lotion has been transferred from the handle 12 the tray-cover 25 may be detached from the head member 13 by grasping tab 27 and pulling it downwardly while grasping handle 12 close to the head member. This exposes the sponge pad 22 and allows the liquid carried thereby to be applied to the desired location on the user's body. The sponge pad 22 may be subsequently again dipped into the pool of liquid 40 in the detached tray-cover 25 to remoisten the bottom surface portion of the sponge pad 22 to allow continued application of the liquid to the user's body. To renew the supply of liquid in the tray 25, it is snap-locked to the head member 13 and the liquid transfer procedure is repeated. After completion of the application of the liquid, the tray-cover 25 is snap-locked to the head member 13 to prevent waste of the liquid by drying out of the sponge pad and to prevent contamination of said sponge pad. Thus, loss by evaporation or other causes is prevented and the sponge pad 22 is kept in a clean, soft and sanitary condition by the coverage thereof by tray-cover 25 when the device 11 is not being used.

The supply of lotion, or other liquid to be dispensed, may be easily replenished by holding the device in a substantially upright position with screw plug 14 uppermost, unscrewing the plug, pouring the liquid into the handle-reservoir 12 and then replacing the screw plug 14.

The arcuate curvature of the handle-reservoir 12 places the bottom end of tube 29 in the lowermost part of handle 12, in the liquid-transfer position of FIG. 2, insuring efficient liquid transfer via the suction developed by the reciprocation of push button 35, as above described. Such efficient liquid transfer is also obtained when the device is held upright, with the head portion uppermost.

While a specific embodiment of an improved long-handled liquid dispensing applicator has been disclosed in the foregoing description, it will be understood that various modifications within the spirit of the invention may occur to those skilled in the art. Therefore it is intended that no limitations be placed on the invention except as defined by the scope of the appended claims.

What is claimed is:

1. A liquid dispensing applicator device comprising an elongated handle, a head member of extended area rigidly secured to an end of the handle and having a vertical shoulder portion opposite the handle, a pad of sponge-like absorbent material of similar extended area secured to the head member, a tray member for receiving liquid to be dispensed shaped to receive said pad of absorbent material, cooperating snap-fitting interlocking sealing means on the head member and tray member for releasably fastening said tray member to said head member in substantially airtight covering relationship with said pad of absorbent material, wherein said handle is hollow to serve as a reservoir of liquid, and conduit means communicatively connecting said hollow handle with said pad of sponge-like absorbent material, wherein said conduit means includes pump means rigidly secured to said vertical shoulder portion for forcing liquid from said hollow handle to said pad, wherein said handle is in the form of an elongated rigid duct defining a reservoir, wherein said conduit means comprises a tube connected to the intake of said pump means and secured to said head member and extending inside said duct for the major portion of the length of the duct and terminating adjacent the free end of the handle, wherein said free end is arranged to be lowermost when the head member is disposed horizontally, whereby to insure immersion of the end of the tube in the liquid in this position of the device so that with the head member in said horizontal position the pump means may be actuated to form a layer of liquid in the bottom of said tray member sufficient to saturate the bottom portion of said pad, wherein said pump means is provided with a bore containing a pump plunger, said plunger having an externally projecting actuating element located at said vertical shoulder portion for reciprocating the plunger in said bore, and wherein said pump means has a discharge spout which depends from said bore into said pad of sponge-like absorbent material, said pump means including a suction-actuated inlet check valve between said bore and said tube and a pressure-actuated outlet check valve between said bore and said discharge spout located at the entry to said discharge spout.

2. The liquid dispensing applicator device of claim 1, and wherein said rigid duct is provided at its free end with a screw plug defining a removable end closure means.

3. The liquid dispensing applicator device of claim 1, and wherein said tray member tightly fits around said pad of sponge-like absorbent material and exerts compression thereon when it is lockingly interengaged with said head member, said snap-fitting interlocking sealing means on the head member and tray member comprising a peripheral marginal rib on one member and a peripheral channel on the other member lockingly receiving said peripheral rib.

* * * * *